United States Patent [19]

Meng

[11] 4,156,347

[45] May 29, 1979

[54] PROCESS FOR ACTUATING A HYDRAULIC PRIME MOVER THROUGH CONVERSION OF ENERGY IN WATER CURRENT

[76] Inventor: Huan-Hsiung Meng, No. 5, Chung Ta Hsin Ts'un, Chung Li, Taiwan

[21] Appl. No.: 829,185

[22] Filed: Aug. 30, 1977

[51] Int. Cl.[2] ..... F15B 3/00

[52] U.S. Cl. ..... 60/327; 60/369; 60/398; 290/54

[58] Field of Search ..... 60/325, 327, 369, 370, 60/371, 398; 290/42, 43, 53, 54; 417/100, 330

[56] References Cited

U.S. PATENT DOCUMENTS

| | | | |
|---|---|---|---|
| 610,790 | 9/1898 | Beckers | 417/85 |
| 1,008,682 | 11/1911 | Wall | 417/330 |
| 3,436,914 | 4/1969 | Rosfelder | 60/398 |

*Primary Examiner*—Edgar W. Geoghegan
*Attorney, Agent, or Firm*—Burns, Doane, Swecker & Mathis

[57] ABSTRACT

Process for actuating a hydraulic prime mover through conversion of energy in water current wherein the arrangement for carrying out the process comprises at least one set of three coaxially disposed pipes. The central or main pipe serves as a cylinder to receive the impulses of the water current while the two sleeve pipes serve for bypassing the main pipe. A complex piston consisting of a chamber containing an elastic working substance and provided with a conventional piston therein is slidable in the cylinder and connected to an engine crankshaft. Valve and lock means are provided to regulate movement of the complex piston so that the kinetic energy can first be absorbed and stored as potential energy and later released to actuate the engine.

9 Claims, 19 Drawing Figures

PROCESS FOR ACTUATING A HYDRAULIC PRIME MOVER THROUGH CONVERSION OF ENERGY IN WATER CURRENT

FIELD OF INVENTION

The present invention relates generally to a process for actuating a hydraulic prime mover through conversion of energy in a water current.

More particularly, the invention relates to a process for actuating a hydraulic engine comprising at least one set of three coaxially disposed pipes wherein the central or main pipe serves as a cylinder to receive the impulse of the water current. The complete set of pipes is installed under water with the front openings of the pipes opening opposite to the direction of the current of a river, ocean or sea. A chamber containing an elastic working substance and provided with a piston is slidably retained in the main pipe to absorb the kinetic energy of the water impulses. The impulses are converted to potential energy which is later released through connecting means attached to the piston to actuate a crankshaft of an engine, thereby converting the stored energy into kinetic energy. Valve means are provided on the main pipe wall to regulate the water flow and lock means are provided both on the main pipe wall and the chamber wall to limit the movement of the chamber as well as the piston. Three lids are provided to cover respectively the main pipe, and the two coaxial sleeve pipes for the purpose of selectively receiving or bypassing the current flow.

BACKGROUND OF INVENTION

Ever since the oil crisis, efforts have been undertaken for seeking other energy sources. One proposed energy source is to convert the kinetic energy of running water in an ocean, sea or river into usable form. However, most of the conventional hydraulic engines designed for this purpose utilized the energy of water flowing through the engine itself. The present inventor has taken into consideration the possibility of utilizing the whole kinetic energy of flowing water in a fixed length of pipe. The impulse produced by the water is first abosrbed through a complex piston means containing a compressible elastic substance and later released to actuate a crankshaft of the engine. The installation and maintenance cost of the engine is reduced due to the simplicity of the engine and mechanical efficiency is increased.

SUMMARY OF INVENTION

The main object of the present invention is to provide a novel process for actuating a hydraulic engine in which the kinetic energy of running water in an ocean, sea or river is absorbed through a working medium of an elastic substance. The kinetic energy of the water is stored as potential energy by the elastic substance with the elastic substance then being positioned so that the absorbed energy can be released. The stored potential energy is converted back into kinetic energy for driving a hydraulic engine much more effectively, drawing more energy from the running water of the ocean, sea or river in comparison to prior known devices.

A further object of the present invention is to provide a process for actuating a hydraulic engine which is to be installed under water with its front end facing the direction of the current of a river, sea or ocean. The engine comprises at least one set of three coaxially disposed pipes of which the central or main pipe serves as a cylinder. A complex piston means slidable in the cylinder has therein a chamber containing an elastic substance and a conventional piston which is slidably mounted in the chamber and connected to the crankshaft of the engine. The impulse of the current is absorbed first by the complex piston and stored as potential energy and then released to actuate the crankshaft.

Another object of the present invention is to provide a process for actuating a hydraulic engine wherein the two sleeve pipes outside the main pipe serve to bypass the water current in order to aid the rightward or return stroke of complex piston. Lids are provided on the front end of the pipes and are selectively opened and closed to provide for reciprocation of the complex piston.

Still another object of the present invention is to provide a process for actuating a hydraulic engine wherein valve and lock means are provided on the main pipe and the complex piston means. The valve and lock means are selectively opened and closed to regulate the movement of the complex piston means.

A still further object of the present invention is to provide a process for actuating a hydraulic engine wherein the sequence of operation is controlled by an electronically programmed device.

Other objects and features will become apparent from the following detailed description with reference to the annexed drawings.

BRIEF DESCRIPTION OF DRAWINGS

FIG. 2 is a longitudinal sectional view of FIG. 1 being a side view of FIG. 1 whereas FIG. 1 is a plan view showing angles of a revolving crankshaft and the connecting rod;

DETAILED DESCRIPTION OF EMBODIMENT

Figure 1:
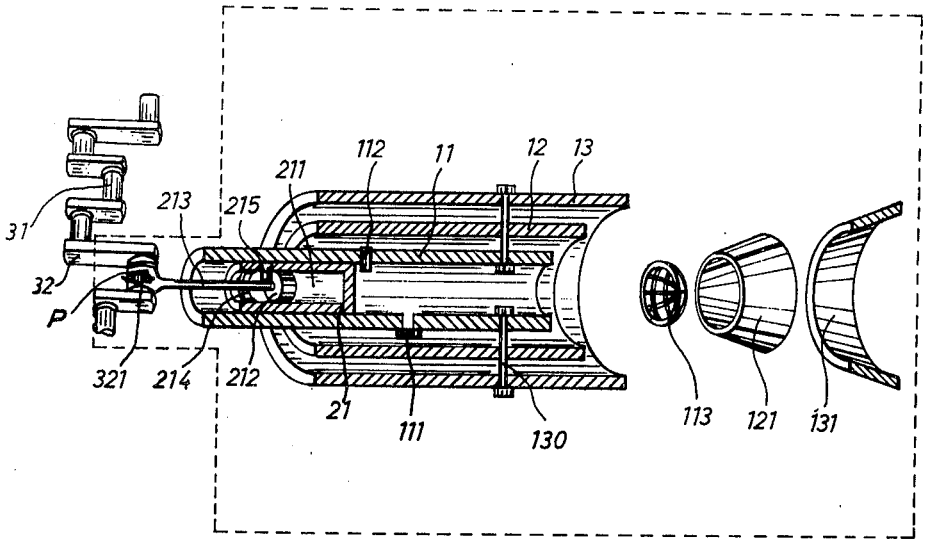
FIG. 1 is a perspective view of an embodiment of the hydraulic engine for carrying out the process of the present invention, shown in a partial cutaway.
Figure 2:
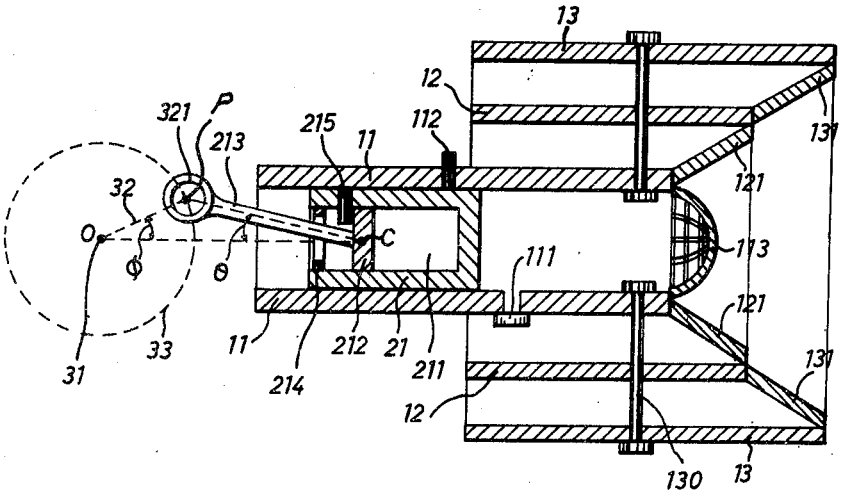

With reference to FIGS. 1 and 2, the engine of the process of the present invention has at least one set of three coaxial pipes 11, 12 and 13, which are disposed concentrically and fastened together with bolts 130. The first or central main pipe 11 serves as a cylinder having a complex piston means 21 slidably retained therein. The complex piston means 21 has a cylindrical chamber 211 with an elastic working substance K such as gas or linear elastic working substance contained therein. Slidably mounted within the chamber 211 is a conventional piston 212 provided with a rod 213 to connect with a crank 32 of a crankshaft 31 of the engine. A flywheel 33 (see FIG. 2) is attached to the crankshaft 31 as in a conventional engine. A permanent lock ring 214 is fixed at the inner wall of the open end of the chamber 211 to prevent the piston 212 from slipping out of the chamber 211. Near the open end of the chamber 211 and through the wall of the chamber 211 a controllable lock 215 is provided which is selectively extended and retracted from the inner wall of the chamber by a guiding mechanism that will be described later. Positioned less than halfway along the leftward stroke of the complex piston means 21 is another controllable lock 112 which is also extended and retracted through the wall of cylinder 11 by a guiding mechanism which will be described later. Also along the wall of main pipe 11 is a valve 111 which is controlled by a cam mechanism to be described later. The main pipe 11, intermediate or second sleeve pipe 12 and the outer or third sleeve pipe 13 are arranged with their front ends disposed in a stepwise manner and are respectively provided with lids 113, 121 and 131 which are selectively opened and closed by cam means which shall be described later.

In FIG. 1, the dotted line defines a single unit of the engine used in the process of the present invention. A plurality of such units may be provided with multiple cranks such as in a multiple cylinder internal combustion engine.

Figure 3:
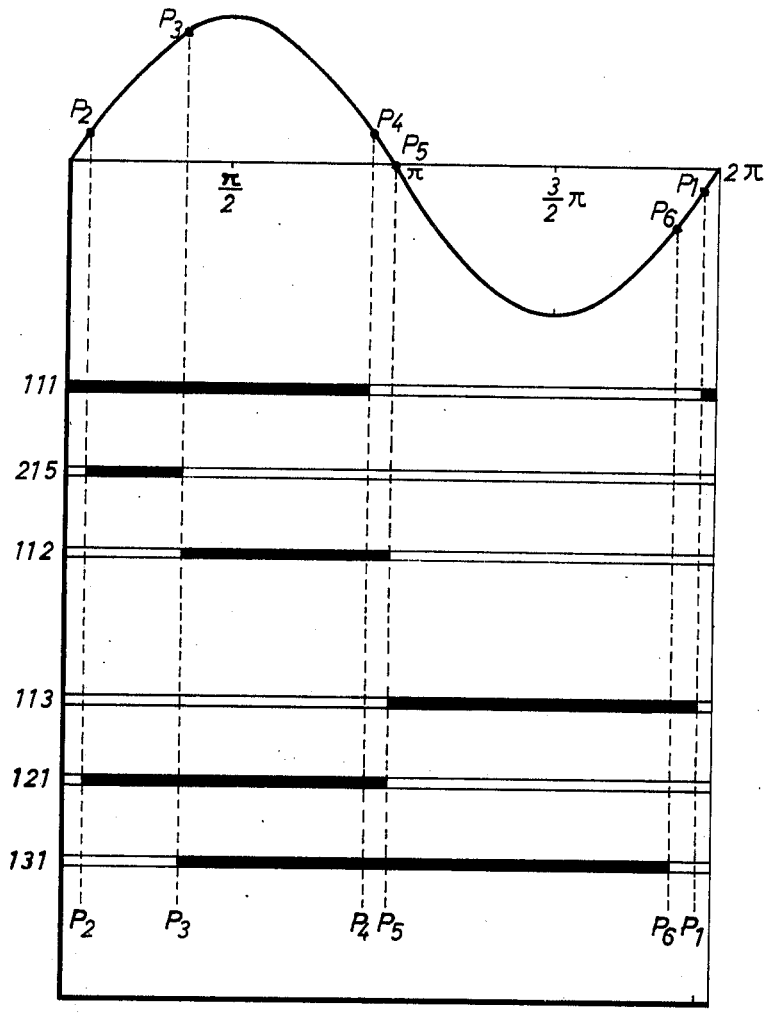
FIG. 3 is a diagram of the working sequence showing the position of the piston during one revolution or cycle of the crankshaft.
Figure 3:
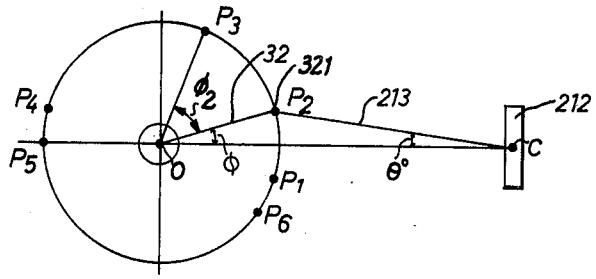

FIG. 3 illustrates the operation or working sequence of the engine of the present invention which is to be described with reference to the other related drawings.

As shown in FIG. 3, O is the center of crankshaft 31, P is the connecting point (321 in FIG. 1) of the connecting rod 213 to the crank 32, and C is the center of piston 212. $\phi$ is the angle between the lines joining PO and OC and $\theta$ is the angle between the lines joining PC and CO. The angles $\theta$ and $\phi$ above CO are viewed as positive and below CO as negative.

Again referring to FIGS. 1 and 3, opening of the lid 113, with the valve 111 normally being open, permits the running water to flow steadily into the main pipe 11 (meaning that at every definite point within the main pipe 11, the partial derivative of the velocity with respect to the time of running water $(dv/dt)=0$). When the point P rotates to $P_1$, the value of $\theta$ is slightly less than zero, and the linear velocity of piston 212 is $(dx/dt)_{212}=0$, with the points C, P and O being nearly colinear. By closing the valve 111, the running water is prevented from flowing, causing an increase in the pressure exerted on the close end or right wall of the complex piston 21. The increased pressure compresses the chamber of elastic working substance with the piston, and the volume of the chamber 211 is decreased.

After a short time interval $t_m$, point P reaches $P_2$. At this time $\theta$ is slightly greater than zero. The linear velocity of piston 212 $(dx/dt)_{212}$ is still nearly equal to zero. The velocity of the water in main pipe 11 is reduced nearly to zero. During this phase, lock 215 extends from inside the chamber wall to keep the volume of elastic working substance to a minimum value and the lid 121 of the pipe 12 is closed.

Figure 4:
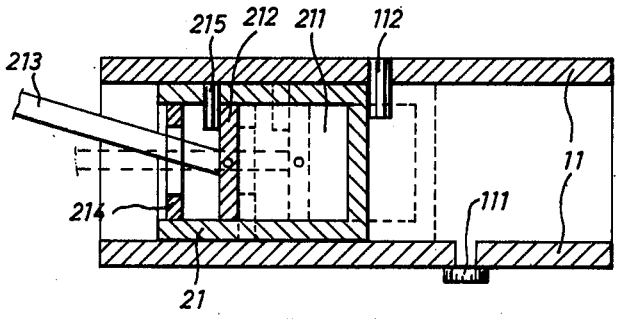
FIG. 4 is a longitudinal sectional view showing working positions of the complex piston means or the chamber of elastic working substance in the main pipe or cylinder.

As shown in FIG. 4, when point P reaches $P_3$, angle $\phi=\phi_2$, and the close end or right end wall of the chamber 21 reaches the solid line position. At this stage lock 112 is extended, lock 215 is released and the lid 131 of the sleeve pipe 13 is closed. The volume of the chamber 211 expands, activating the connecting rod 213 and delivering energy to the prime mover.

As point P reaches $P_4$, $\phi$ is nearly equal to radians and $\theta$ approaches zero again. Valve 111 of the main pipe 11 is opened and the lock 112 released.

As point P rotates to $P_5$, angle $\phi$=radians and $\theta$ equals zero again. The lid 113 of the main pipe 11 is closed to shield the right wall of the chamber 211 from the impact of running water, when the lid 121 of the sleeve pipe 12 is then opened. Since the wall of the piston 21 moves to the right, the volume within the main pipe 11 is reduced, and water within pipe 11 has to be drained. By opening the lid 121 of the sleeve pipe 12 and closing the lid 113 of the main pipe 11 (at this instant the lid 131 of the pipe 13 has already been closed) the water that tends to flow into the main pipe 11 and the outer sleeve pipe 13 can be diverted to intermediate sleeve pipe 12. The velocity of the water flowing in the intermediate sleeve pipe 12 is thereby increased. According to Bernoulli's Principle, an increase in the velocity of flowing fluid decreases the pressure. Accordingly, the water current in the intermediate sleeve pipe 12 forces the water in the main pipe 11 to flow out of the pipe through valve 111 and indirectly causes the chamber of the piston means 21 of elastic working substance to move forward toward the right side.

When point P reaches $P_6$, the lids 113 and 131 are opened in order to expose the water in main pipe 11 to the impulses of the water current outside the main pipe 11. The water in the main pipe 11 is accelerated by the velocity of the water current so that the water flows in steadily from the front (right) opening of the main pipe 11 and flows out through the valve 111.

When the point P reaches $P_1$, valve 111 is again closed. At the instant of the closing of valve 111, the pressure in main pipe 11 increases suddenly. Thus, the pressure in the intermediate pipe 12 should not be decreased and the lid 131 of the outer sleeve pipe 13 remains opened. Otherwise, the main pipe 11 would be easily ruined. The return of point P to $P_1$ completes one cycle of the engine of the present invention.

The foregoing description relates only to one unit of the fundamental construction relating to the present process which is equivalent to a single cylinder reciprocating engine. The number of such units required in this kind of prime mover is determined by the current velocity, the expected r.p.m. of the mover, total output, etc. The locations of $P_1$, $P_2$ . . . , angles $\phi$ and $\theta$, etc. should be calculated in view of the environment in which the engine is used. The specifics relating to the determination of the values of the parameters are outside the scope of the patent and are omitted. In operation, applying and releasing of the locks and opening or closing of the lids or the valve are all preferrably controlled by electronic devices.

However, mechanical means such as cam or guiding mechanisms may be used for performing the above mentioned functions. FIGS. 5 to 18 illustrate various embodiments showing the details of the mechanical controls.

Figure 5:
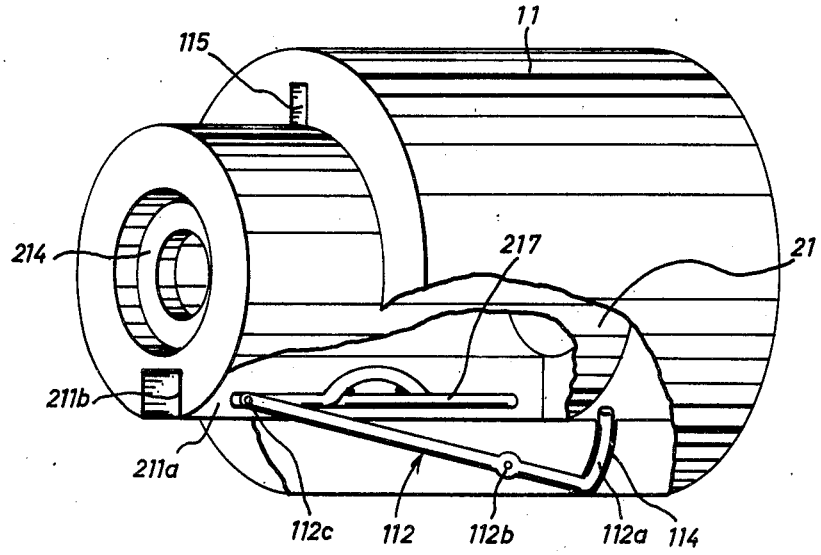
FIG. 5 is a perspective view showing the detail of an embodiment of the second lock means.

In FIG. 5, a permanent lock ring 214 is fixedly disposed at the rear or left end of the piston means 21 (piston 212 and rod 213 are omitted in the figure) to prevent piston 212 from sliding out of the piston means 21. On the wall of main pipe 11, a rocker lever type lock means 112 is provided having a fulcrum pivoted at **112*b* on the wall of main pipe 11 and the lock end 112*a* swinging in and out a hole 114 provided on the wall. The lock end 112*a* is spaced less than halfway along the leftward stroke of piston means 21. The guide end 112*c* of the lock means 112 is slidably guided by a single way guiding groove 217 built-into the wall 211*a* of the notch 211*b* cut from the piston means 21. Details of the groove 217 shall be related later in FIG. 7. A notch 115 is cut from inside the wall of main pipe 11 to retain a like swing lock means 215 as shown in FIG. 6**.

Figure 6:
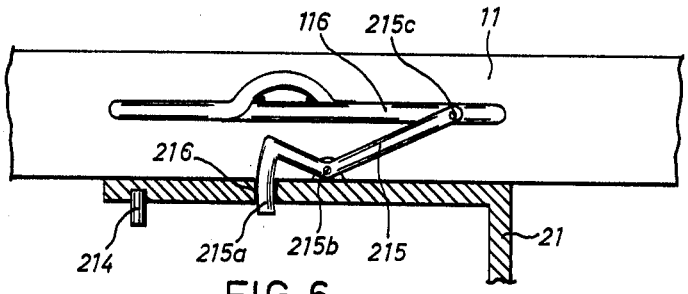
FIG. 6 is a perspective view showing the detail of an embodiment of the first lock means.

As shown in FIG. 6, a lock means 215 is provided to lock the chamber 21 at a leftward position. The lock means 215 is also a rocker lever type which is disposed at the inner wall of the rear open end of the chamber. The lock means 215 has a fulcrum pivoted at **215*b* raised on the outside wall of piston means 21. The lock end 215*a* is capable of pivoting in and out of a hole 216 provided midway along the wall of piston means 21. Guide end 215*c* slidably travels in a one-way guiding groove 115 built-into the wall 115 of the main pipe 11**.

Figure 7:
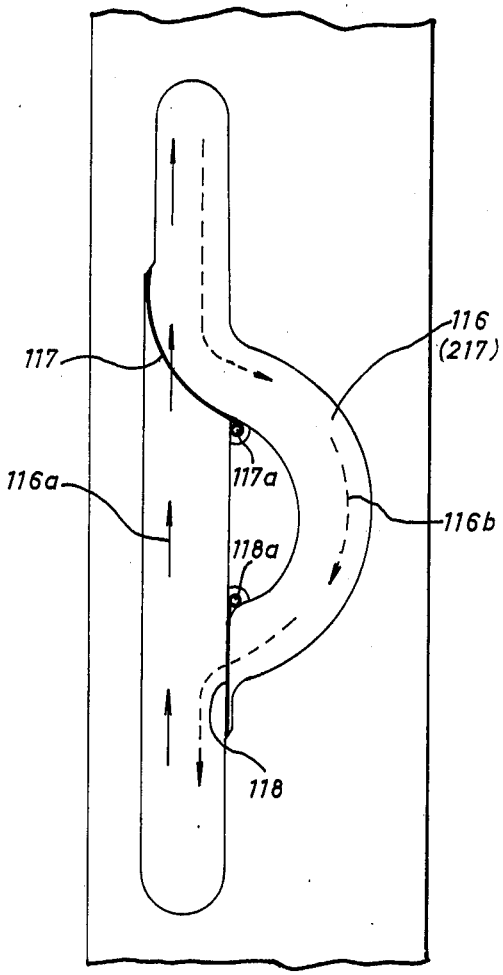
FIG. 7 is a schematic view of a one-way guide groove for the first and second lock means.

The one-way guiding groove 217 is similar to the groove 116 as shown in FIG. 7. The groove 116 (217) comprises a forward path **116*a* (solid arrow) and a return path 116*b* (dotted arrow). The pivoting of the lock means is accomplished by the guide end which travels along each of the alternative paths. One-way checks 117, 118 cause the guide end of the swing lock means to go forward and return by the different paths without going astray. The single way check 117 (118) is pivoted at 117*a* (118*a*) and biased to a normal position, shown in FIG. 7**, by a spring means not illustrated.

Figure 8:
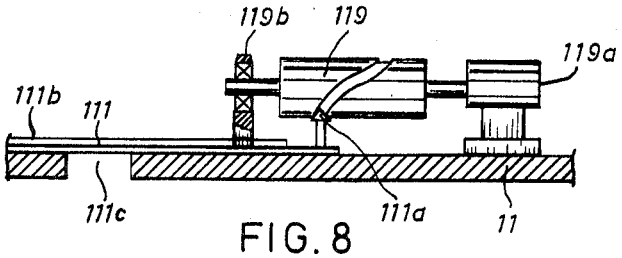
FIG. 8 is a schematic view showing an embodiment of a cam drive for the valve and lids.
Figure 9:
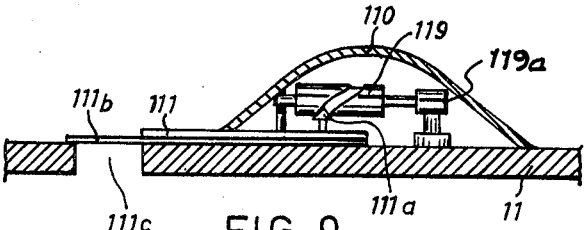
FIG. 9 is a longitudinal section of the installation of a streamline cover enclosing the driving motor of the cam drive in FIG. 8.
Figure 10:
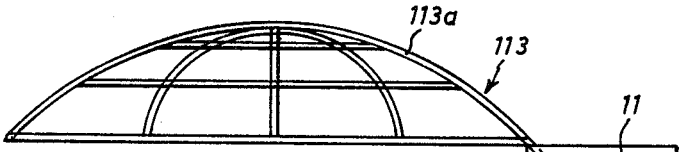
FIG. 10 is a side view showing a guide structure of a first lid for covering up the main pipe.
Figure 12:
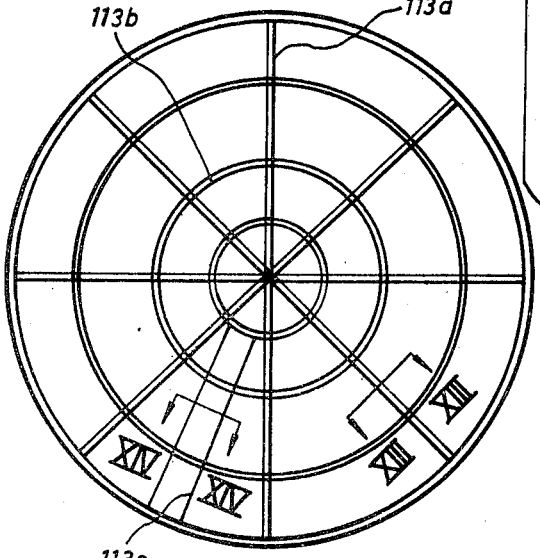
FIG. 12 is a front end view of the said lid covering up the main pipe.

In FIG. 8, a cam means 119 with a driving motor **119*a* and a bearing support 119*b* is provided outside the wall of main pipe 11. The cam and motor drives the sliding valve 111 which is moved by follower 111*a* and guided by a pair of sliding guide rails 111*b*. The sliding valve 111 is moved back and forth to open and close the opening 111*c* in the wall of main pipe 11 such as shown in FIG. 8 and FIG. 9. In FIG. 9, a stream line cover 110 is provided to enclose the cam means 119 and the driving synchronous motor 119*a*** to avoid direct impact of the water current.

Similar cam means may also be used to open and close the three lids 113, 121 and 131, details of which are illustrated in FIGS. 10 thru 18.

The constructions of the lids 113, 121 and 131 are generally the same. Each lid has a rigid structure member divided into radial sections. The sections of the lids are slidably mounted on the rigid structure member and retract into the lid sections.

Figure 11:
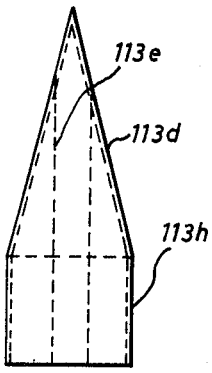
FIG. 11 is a side view showing a section of the lid in FIG. 10.
Figure 13:
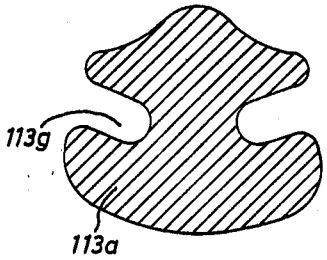
FIG. 13 is a cross sectional view of the guide member of the lid for the main pipe.
Figure 14:
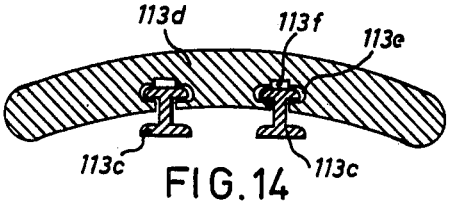
FIG. 14 is a cross sectional view showing a pair of parallel guide rails for the lid of the main pipe.
Figure 16:
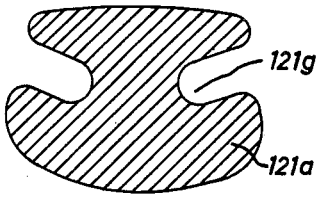
FIG. 16 is a cross sectional view of a guide member of the second and third lids.

In FIGS. 10 thru 13, the lid 113 for the main pipe 11 is illustrated. The structure for supporting lid 113 with radial members **113*a* and circular members 113*b* is mounted on the wall of pipe 11 and the dotted line within wall 11 of the main pipe shows the sections of the lid 113*d* in a retracted position. A section of the lid 113*d* has grooves 113*e* provided at the back of the section to retain a pair of parallel rails 113*c* (actually two curved rails, lying within two symmetrical parallel planes intersecting the spherical surface) disposed between the pair of radial members 113*a*. On top of rail 113*c*, roller 113*f* is provided to effect a smoother running of the lid sections 113*d* (FIG. 14). Spherical angular sides of lid section 113*d* are slidably retained in the groove 113*g* of the radial member 113*a* (FIG. 13). The parallel circular side of extending portion 113*h* of the lid section is still retained within the wall of pipe 11 (FIG. 11**).

Figure 15:
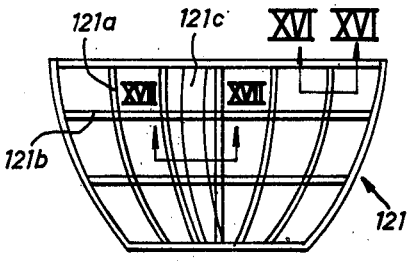
FIG. 15 is a side view showing the guide structure of a second lid for an intermediate sleeve pipe.
Figure 17:
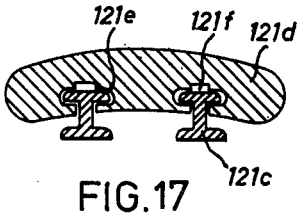
FIG. 17 is a cross sectional view showing a pair of parallel guide rails for the said second and third lids.
Figure 15A:
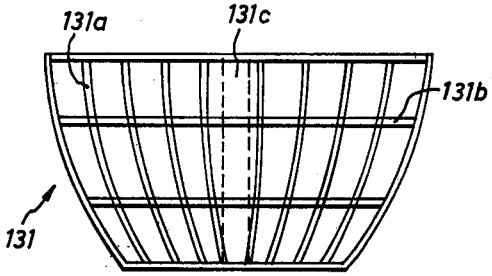
FIG. 15A is a side view showing the guide structure of a third lid for an outer sleeve pipe.
Figure 18:
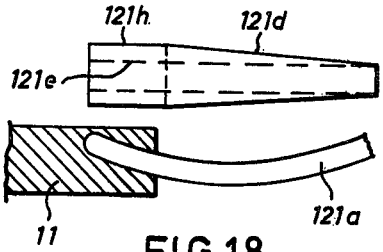
FIG. 18 is a front and side view showing a section of the second or third lid.

The lid 113 is substantially convex, whereas the lids 121 and 131 are substantially concave, each having a different degree of curvature as shown in FIGS. 15 and 15A. The suffixes a, b, c, d, e, f, and g after each part number in FIGS. 15 thru 18 are defined in the same manner as shown in FIGS. 10 thru 14. Therefore, no further descriptions of these elements will be provided.

The opening and closing of the lid sections may use the same cam means as shown in FIG. 8 or any other practical means.

A primary purpose of this application is to employ a process which converts the energy in water current into performable work. The embodiment described herein is given only for the purpose of illustration and is not to be construed as a limitation. Detailed design of feasible prime movers lies in the hands of skilled engineers, and modifications, will become evident to those skilled in the art and such modifications are intended to fall within the scope of the attached claims.

What is claimed is:

1. A process for actuating a hydraulic prime mover through conversion of energy in water current comprising the steps of:

drawing a water current into a confined main path; stopping the water current to produce an impulse caused by the kinetic energy contained in the current;

absorbing the impulse through an elastic working substance which is enclosed in a resilient chamber located at the rear end of the said confined main path to convert the kinetic energy of the water current into potential energy stored by said working substance;

moving the chamber carrying the potential energy storing elastic working substance to a location wherein the stored potential energy is converted into kinetic energy for driving a hydraulic prime mover; and retracting the resilient chamber to an initial position by creating a pressure differential across said main path.

2. The process according to claim 1 wherein the drawing step draws water into a confined main path defined by a first cylinder coaxially disposed within second and third cylinders which bypass said first cylinder, each of said cylinders being provided with a lid which is selectively opened to regulate flow therethrough, wherein closing of a normally open valve on a wall of said first cylinder stops the flow of water.

3. The process according to claim 1 wherein the absorbing step absorbs impulses through a resilient chamber defined by a complex piston containing said elastic working substance which is slidable within said first cylinder, the complex piston including a slidable piston which is retained in the rear open end of the resilient chamber having a connecting rod connected to a crankshaft of said hydraulic prime mover, thereby actuating said prime mover through reciprocation of said complex piston.

4. The process according to claim 3 including the steps of:

selectively extending a first retractable lock provided halfway along an inner wall of said first cylinder to stop rightward movement of said complex piston during expansion of said elastic working substance; and selectively extending a second retractable lock provided along the inner wall at the rear open end of said resilient chamber to permit said reciprocating piston to carry said chamber leftward;

wherein said chamber is provided with a fixed lock to retain said reciprocating piston within said resilient chamber.

5. The process according to claim 1 wherein said absorbing step for absorbing said impulses of the water current uses a linear elastic working substance.

6. The process according to claim 4 wherein the first retractable lock is a rocker lever pivoted at the wall of said first cylinder, said rocker lever having a lock portion which is selectively extended through a groove in said wall and a guide portion traveling in a one-way groove disposed in the wall of said resilient chamber.

7. The process according to claim 4 wherein the second retractable lock is a rocker lever pivoted at the outer wall of said resilient chamber, said rocker lever having a lock portion which is selectively extended through a groove in said wall and a guide portion travelling in a one-way groove in the wall of said first cylinder.

8. The process according to claim 2 wherein the step of closing of said normally open valve includes driving a slidable valve portion with a cam driven by an electric motor and guiding said valve portion along rails disposed on the other wall of said first cylinder.

9. The process according to claim 2 wherein said lids on said first, second and third cylinders are curved sections, said lids being selectively retracted into respective cylinder walls along guide rails and a supporting structure for said lids.

* * * * *